US007066407B2

(12) United States Patent
Lu

(10) Patent No.: US 7,066,407 B2
(45) Date of Patent: Jun. 27, 2006

(54) SHOWER HEAD ASSEMBLY

(76) Inventor: Tung Hsien Lu, No. 289, Peng Yi Rd., Taipei City, Taichung County 411 (TW)

( * ) Notice: Subject to any disclaimer, the term of this patent is extended or adjusted under 35 U.S.C. 154(b) by 190 days.

(21) Appl. No.: 10/901,495

(22) Filed: Jul. 26, 2004

(65) Prior Publication Data

US 2006/0016911 A1 Jan. 26, 2006

(51) Int. Cl.

| | |
|---|---|
| ***B05B 1/34*** | (2006.01) |
| ***B05B 1/16*** | (2006.01) |
| ***B05B 1/28*** | (2006.01) |
| ***B05B 1/14*** | (2006.01) |

(52) U.S. Cl. ..... 239/380; 239/381; 239/382; 239/383; 239/104; 239/462; 239/463

(58) Field of Classification Search ..... 239/380–383, 239/104, 106, 121, 390, 394, 396, 462, 439, 239/440, 441, 463

See application file for complete search history.

(56) References Cited

U.S. PATENT DOCUMENTS

| | | | | |
|---|---|---|---|---|
| 5,577,664 | A * | 11/1996 | Heitzman | 239/99 |
| 5,860,599 | A * | 1/1999 | Lin | 239/443 |
| 5,961,046 | A * | 10/1999 | Joubran | 239/107 |
| 6,076,747 | A * | 6/2000 | Ming-Yuan | 239/383 |
| 6,533,194 | B1 * | 3/2003 | Marsh et al. | 239/383 |
| 6,607,148 | B1 * | 8/2003 | Marsh et al. | 239/447 |
| 6,796,518 | B1 * | 9/2004 | Douglas et al. | 239/587.4 |

* cited by examiner

*Primary Examiner*—Davis Hwu
(74) *Attorney, Agent, or Firm*—Charles E. Baxley

(57) ABSTRACT

A shower head assembly includes an outer housing, an inner housing, a catch cap, and an impeller. Thus, the catch cap catches the water flow and introduces the water flow through the water inlet hole into the air chamber so as to reduce the water flow rate, thereby achieving the purpose of saving water. In addition, the water flow is ejected outward in a radiating manner by rotation of the impeller, thereby providing a massaging effect to the user.

19 Claims, 6 Drawing Sheets

SHOWER HEAD ASSEMBLY

BACKGROUND OF THE INVENTION

1. Field of the Invention

The present invention relates to a shower head assembly, and more particularly to a shower head assembly that saves the water resource.

2. Description of the Related Art

A conventional shower head comprises a universal connector attached to a wall and connected to a water pipe, a main body having a first end mounted on the universal connector, and a water outlet panel mounted on a second end of the main body and formed with a plurality of water outlet holes. When in use, the water flow from the water pipe flows through the universal connector, the main body and the water outlet panel and is injected outward from the water outlet holes of the water outlet panel. However, the water is directly injected outward from the water outlet holes of the water outlet panel, so that the conventional shower head has a greater water flow rate, thereby easily wasting the water resource.

SUMMARY OF THE INVENTION

The primary objective of the present invention is to provide a shower head assembly, wherein the catch cap catches the water flow and introduces the water flow through the water inlet hole into the air chamber so as to reduce the water flow rate, thereby achieving the purpose of saving water.

Another objective of the present invention is to provide a shower head assembly, wherein the water is ejected from the ejection holes of the separation wall of the inner housing in an atomized manner, thereby forming an atomized water flow.

A further objective of the present invention is to provide a shower head assembly, wherein the impeller is rotated by the water flow to drop the water flow outward along the blades, thereby forming a drip water flow.

A further objective of the present invention is to provide a shower head assembly, wherein the water flow is ejected outward in a radiating manner by rotation of the impeller, thereby providing a massaging effect to the user.

In accordance with the present invention, there is provided a shower head assembly, comprising:

an outer housing;

an inner housing mounted in the outer housing and having a mediate portion formed with a separation wall formed with a plurality of ejection holes;

a catch cap rested on a first side of the separation wall of the inner housing and having an inside formed with air chamber communicating with the ejection holes of the separation wall of the inner housing and a central portion formed with a water inlet hole communicating with the air chamber and an inside of the inner housing; and an impeller rotatably mounted on a second side of the separation wall of the inner housing and having a plurality of blades aligning with the ejection holes of the separation wall of the inner housing.

Further benefits and advantages of the present invention will become apparent after a careful reading of the detailed description with appropriate reference to the accompanying drawings.

DETAILED DESCRIPTION OF THE INVENTION

Figure 1:
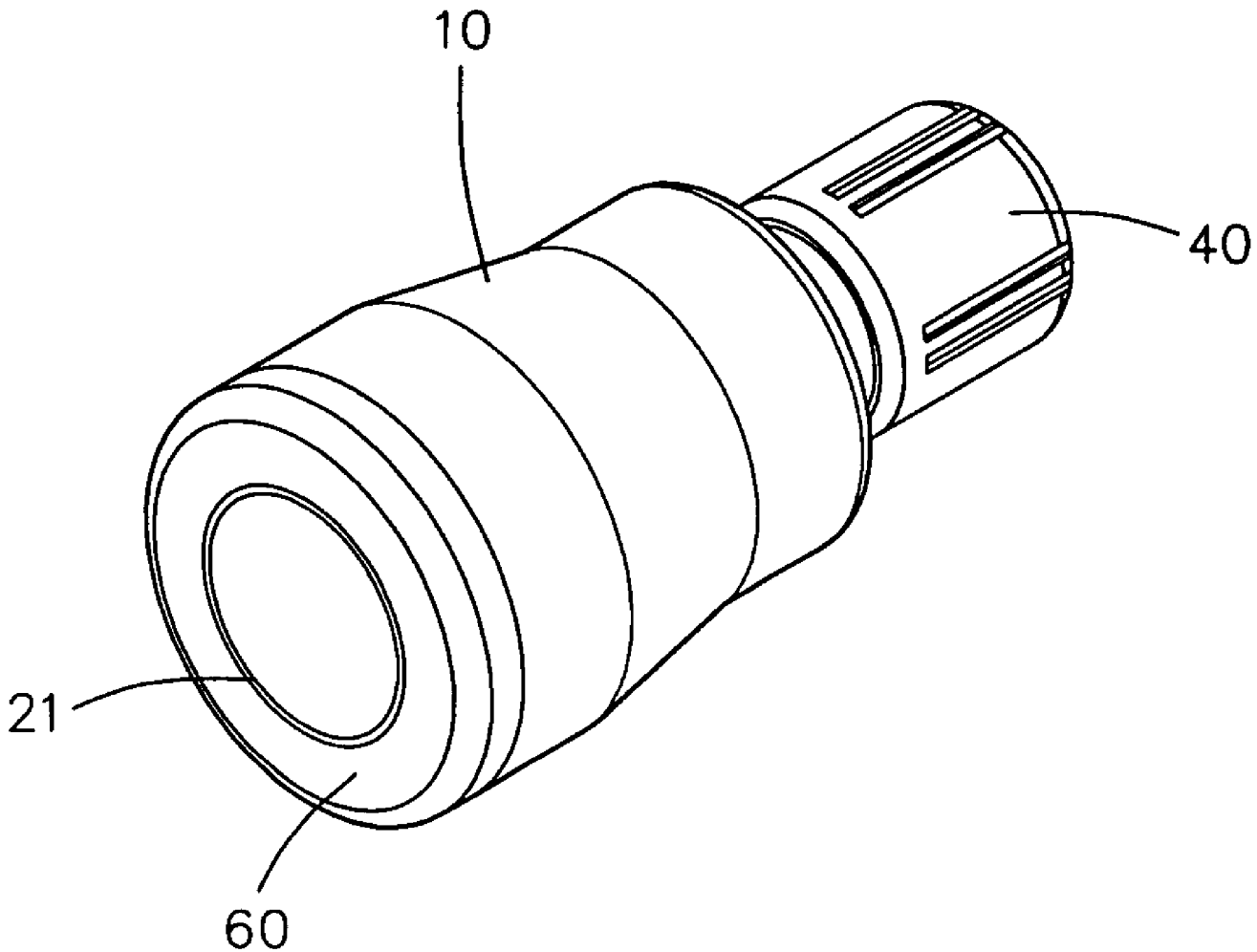
FIG. 1 is a perspective view of a shower head assembly in accordance with the preferred embodiment of the present invention.
Figure 2:
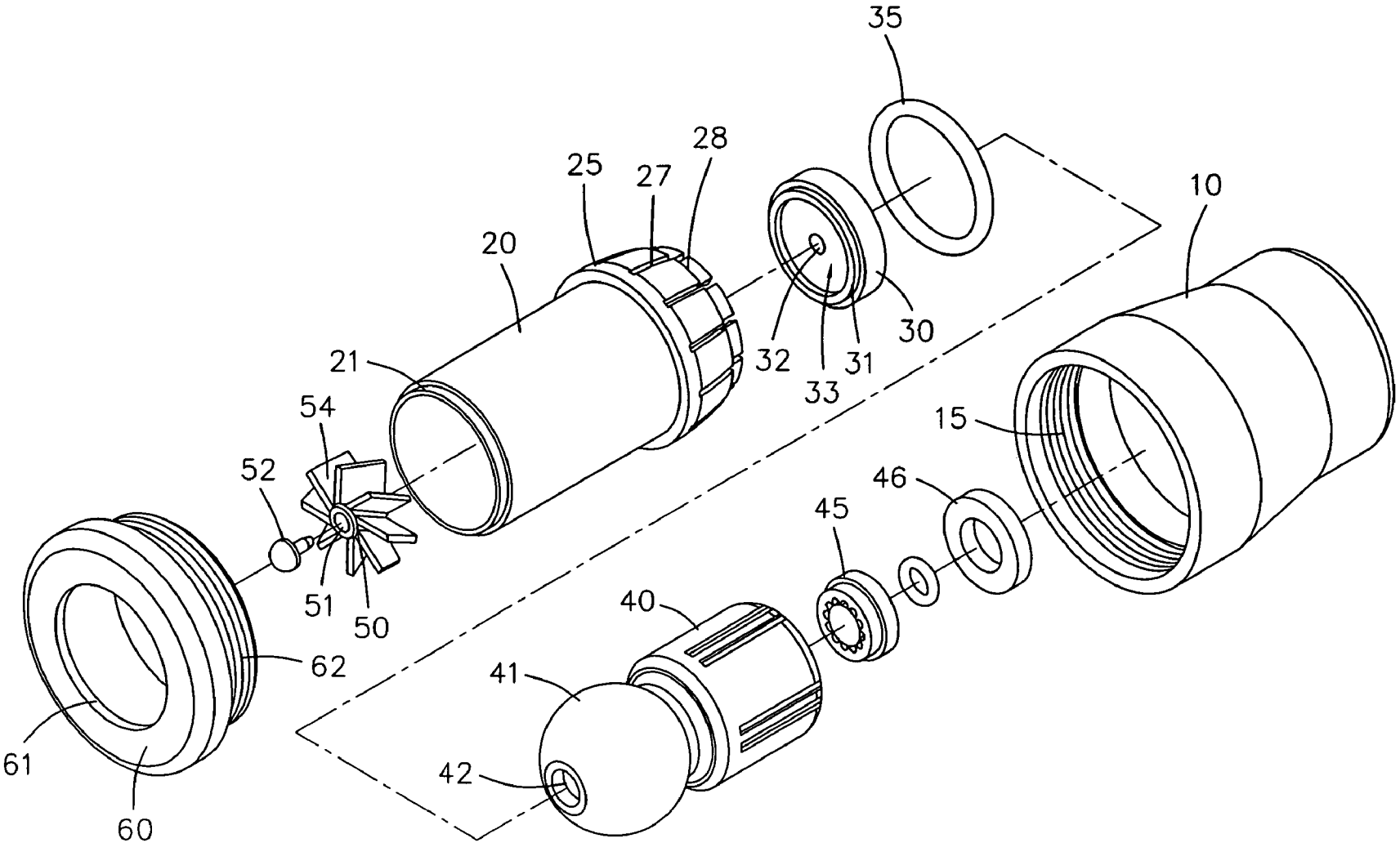
FIG. 2 is an exploded perspective view of the shower head assembly as shown in FIG. 1.
Figure 3:
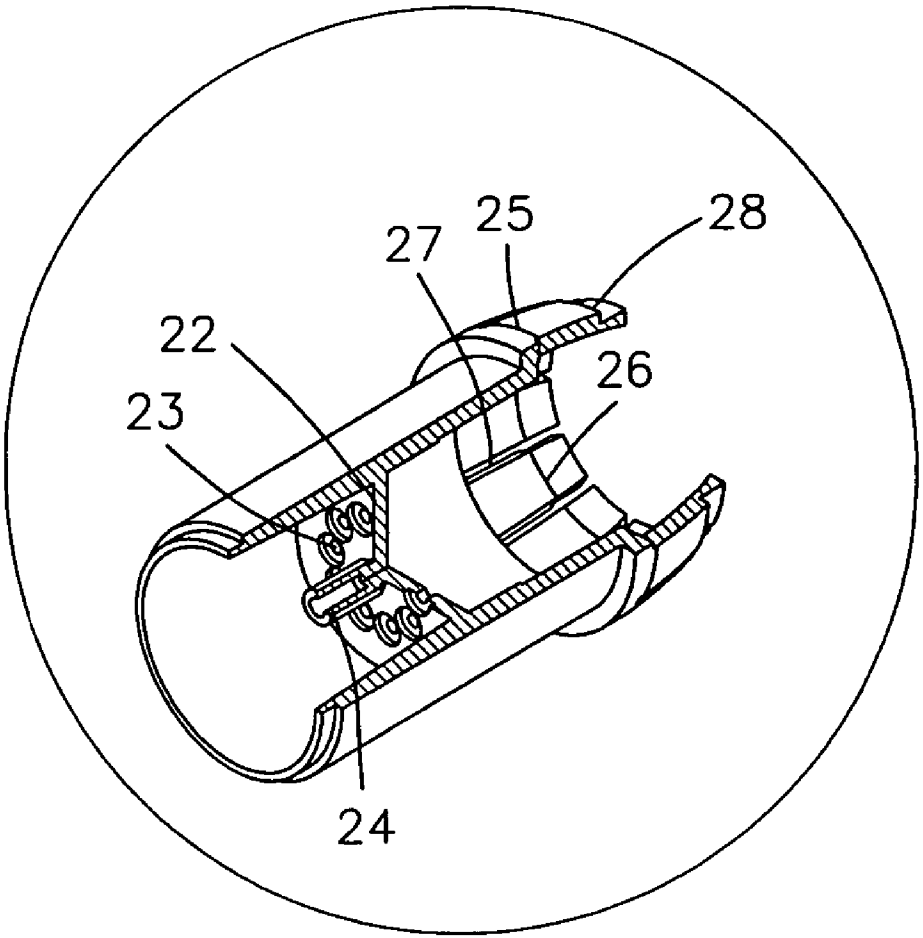
FIG. 3 is a partially perspective cross-sectional view of an inner housing of the shower head assembly as shown in FIG. 2.
Figure 4:
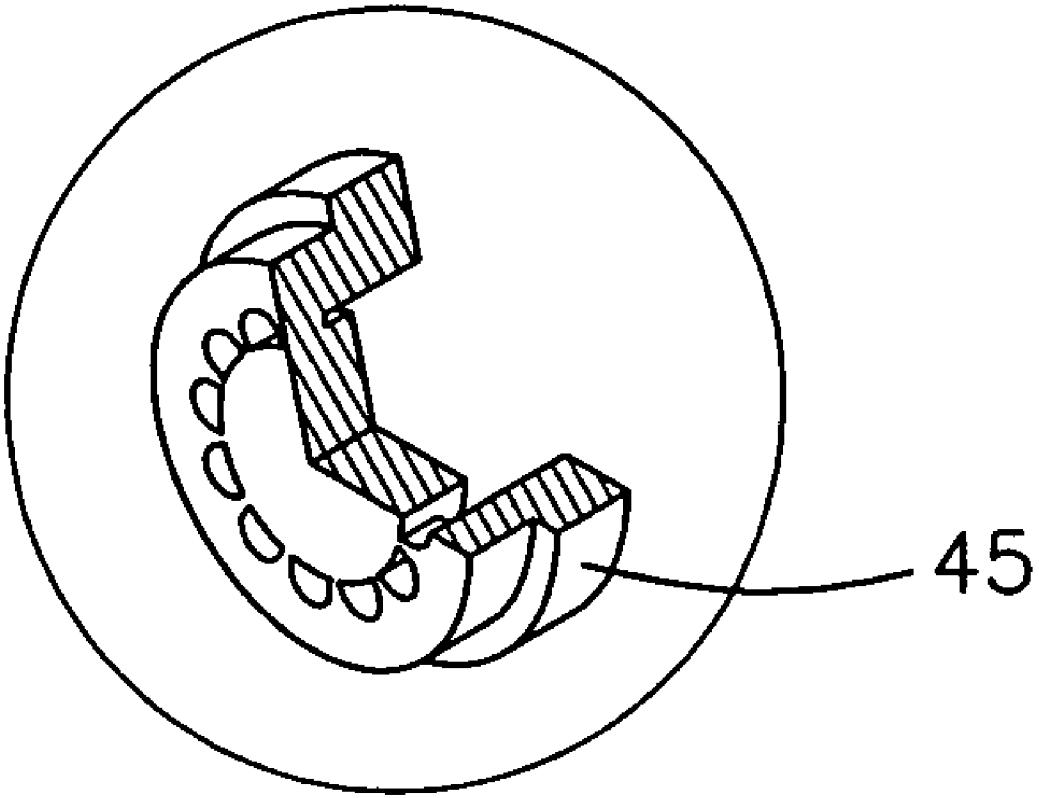
FIG. 4 is a partially perspective cross-sectional view of a gasket of the shower head assembly as shown in FIG. 2.
Figure 5:
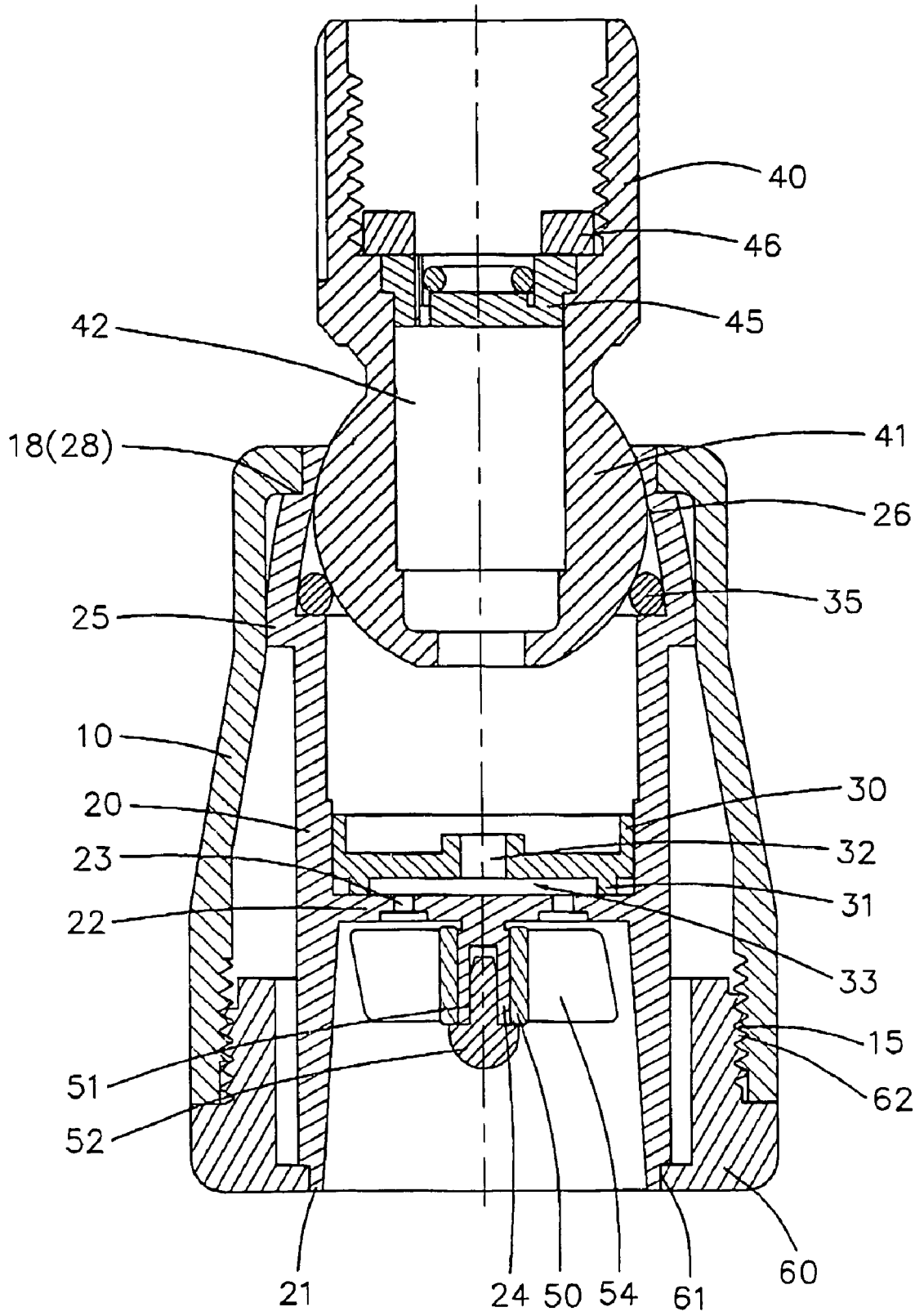
FIG. 5 is a plan cross-sectional view of the shower head assembly as shown in FIG. 1.

Referring to the drawings and initially to FIGS. 1–5, a shower head assembly in accordance with the preferred embodiment of the present invention comprises an outer housing 10, an inner housing 20 mounted in the outer housing 10 and having a mediate portion formed with a separation wall 22 formed with a plurality of ejection holes 23, a catch cap 30 rested on a first side of the separation wall 22 of the inner housing 20 and having an inside formed with air chamber 33 communicating with the ejection holes 23 of the separation wall 22 of the inner housing 20 and a central portion formed with a water inlet hole 32 communicating with the air chamber 33 and an inside of the inner housing 20, and an impeller 50 rotatably mounted on a second side of the separation wall 22 of the inner housing 20 and having a plurality of blades 54 aligning with the ejection holes 23 of the separation wall 22 of the inner housing 20.

The outer housing 10 has a first end formed with an annular stop flange 18 (see FIG. 5) extended radially inward and a second end formed with an inner thread 15.

The inner housing 20 has a first end formed with a wedge-shaped support seat 25 and a second end formed with an annular locking groove 21. The support seat 25 of the inner housing 20 has a distal end formed with an annular retaining groove 28 to receive the stop flange 18 of the outer housing 10. The support seat 25 of the inner housing 20 has a peripheral wall formed with a plurality of axially arranged slits 27, so that the support seat 25 of the inner housing 20 is made flexible. The separation wall 22 of the inner housing 20 has a central portion formed with a pivot shaft 24.

The catch cap 30 is mounted in the inner housing 20 and has a periphery formed with an annular resting edge 31 rested on the first side of the separation wall 22 of the inner housing 20.

A universal connector 40 is mounted on the inner housing 20 and has a first end formed with a ball 41 rotatably mounted in the support seat 25 of the inner housing 20 and a second end protruding outward from the inner housing 20 and connected to a water pipe (not shown). The support seat 25 of the inner housing 20 has an inside formed with an arc-shaped urging face 26 rested on the ball 41 of the universal connector 40. The universal connector 40 has an inside formed with an axially arranged passage 42 communicating with the inside of the inner housing 20. The inside of the universal connector 40 is provided with a gasket 45 and a sealing member 46. An O-ring 35 is mounted between the ball 41 of the universal connector 40 and the support seat 25 of the inner housing 20 to provide an airtight effect.

The impeller 50 is rotatably mounted on the pivot shaft 24 of the inner housing 20 and has an inside formed with a pivot hole 51 pivotally mounted on the pivot shaft 24 of the inner housing 20. A retaining pin 52 is mounted on the pivot shaft 24 of the inner housing 20 and rested on the impeller 50 to retain the impeller 50 on the pivot shaft 24 of the inner housing 20. The retaining pin 52 has a distal end inserted into the pivot shaft 24 of the inner housing 20.

An end cap 60 is mounted on the outer housing 10 and rested on the inner housing 20. The end cap 60 has an inner wall formed with an annular stop lip 61 mounted in the locking groove 21 of the inner housing 20 and an outer wall formed with an outer thread 62 screwed into the inner thread 15 of the outer housing 10.

Figure 6:
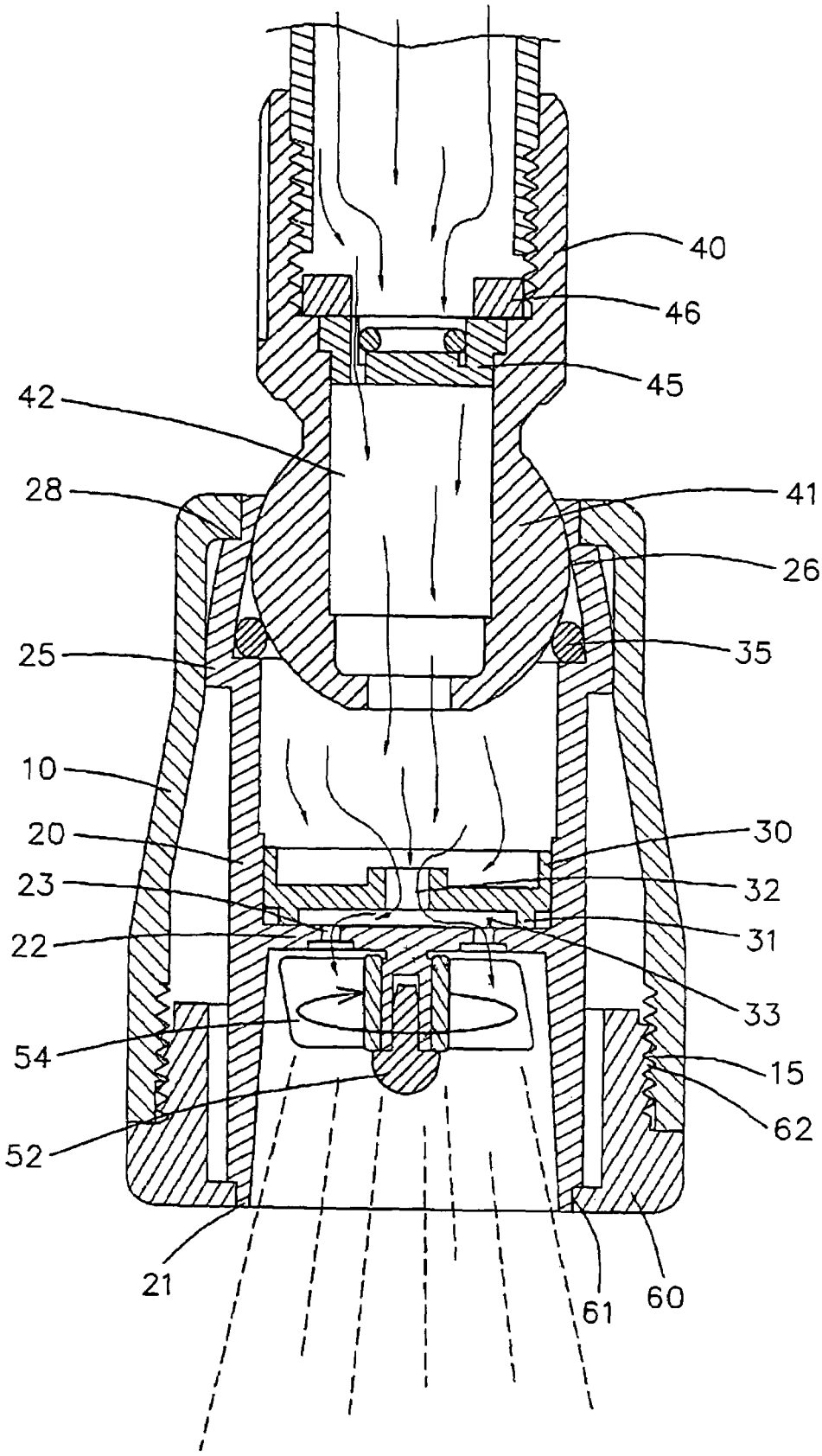
FIG. 6 is a schematic operational view of the shower head assembly as shown in FIG. 5.

In operation, referring to FIGS. 1–6, the water from the water pipe in turn flows through the passage 42 of the universal connector 40, the inside of the inner housing 20, the water inlet hole 32 of the catch cap 30, the air chamber 33 of the catch cap 30, the ejection holes 23 of the separation wall 22 of the inner housing 20 and the impeller 50, and is finally ejected outward from the outer housing 10 for use with a user.

Accordingly, the catch cap 30 catches the water flow and introduces the water flow through the water inlet hole 32 into the air chamber 33 so as to reduce the water flow rate, thereby achieving the purpose of saving water. In addition, the water is ejected from the ejection holes 23 of the separation wall 22 of the inner housing 20 in an atomized manner, thereby forming an atomized water flow. Further, the impeller 50 is rotated by the water flow to drop the water flow outward along the blades 54, thereby forming a drip water flow. Further, the water flow is ejected outward in a radiating manner by rotation of the impeller 50, thereby providing a massaging effect to the user.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A shower head assembly, comprising:

an outer housing;

an inner housing mounted in the outer housing and having a mediate portion formed with a separation wall formed with a plurality of ejection holes;

a catch cap rested on a first side of the separation wall of the inner housing and having an inside formed with air chamber communicating with the ejection holes of the separation wall of the inner housing and a central portion formed with a water inlet hole communicating with the air chamber and an inside of the inner housing; and an impeller rotatably mounted on a second side of the separation wall of the inner housing and having a plurality of blades aligning with the ejection holes of the separation wall of the inner housing.

2. The shower head assembly in accordance with claim 1, wherein the inner housing has a first end formed with a support seat.

3. The shower head assembly in accordance with claim 2, wherein the support seat of the inner housing is wedge-shaped.

4. The shower head assembly in accordance with claim 2, wherein the outer housing has a first end formed with an annular stop flange extended radially inward, and the support seat of the inner housing has a distal end formed with an annular retaining groove to receive the stop flange of the outer housing.

5. The shower head assembly in accordance with claim 2, wherein the support seat of the inner housing has a peripheral wall formed with a plurality of axially arranged slits, so that the support seat of the inner housing is made flexible.

6. The shower head assembly in accordance with claim 2, further comprising a universal connector mounted on the inner housing and having a first end formed with a ball rotatably mounted in the support seat of the inner housing and a second end protruding outward from the inner housing.

7. The shower head assembly in accordance with claim 6, wherein the support seat of the inner housing has an inside formed with an arc-shaped urging face rested on the ball of the universal connector.

8. The shower head assembly in accordance with claim 6, wherein the universal connector has an inside formed with an axially arranged passage communicating with the inside of the inner housing.

9. The shower head assembly in accordance with claim 6, wherein the inside of the universal connector is provided with a gasket and a sealing member.

10. The shower head assembly in accordance with claim 6, further comprising an O-ring mounted between the ball of the universal connector and the support seat of the inner housing to provide an airtight effect.

11. The shower head assembly in accordance with claim 1, wherein the catch cap is mounted in the inner housing.

12. The shower head assembly in accordance with claim 1, wherein the catch cap has a periphery formed with an annular resting edge rested on the first side of the separation wall of the inner housing.

13. The shower head assembly in accordance with claim 1, wherein the separation wall of the inner housing has a central portion formed with a pivot shaft, and the impeller is rotatably mounted on the pivot shaft of the inner housing.

14. The shower head assembly in accordance with claim 13, wherein the impeller has an inside formed with a pivot hole pivotally mounted on the pivot shaft of the inner housing.

15. The shower head assembly in accordance with claim 13, further comprising a retaining pin mounted on the pivot shaft of the inner housing and rested on the impeller to retain the impeller on the pivot shaft of the inner housing.

16. The shower head assembly in accordance with claim 15, wherein the retaining pin has a distal end inserted into the pivot shaft of the inner housing.

17. The shower head assembly in accordance with claim 1, further comprising an end cap mounted on the outer housing and rested on the inner housing.

18. The shower head assembly in accordance with claim 17, wherein the outer housing has and a second end formed with an inner thread, and the end cap has an outer wall formed with an outer thread screwed into the inner thread of the outer housing.

19. The shower head assembly in accordance with claim 17, wherein the inner housing has a second end formed with an annular locking groove, and the end cap has an inner wall formed with an annular stop lip mounted in the locking groove of the inner housing.

* * * * *